US008826604B2

(12) United States Patent
Diniz et al.

(10) Patent No.: US 8,826,604 B2
(45) Date of Patent: Sep. 9, 2014

(54) TELESCOPING TOWER AND LEGS

(71) Applicants: Ronald Liborio Diniz, Ft. Pierce, FL (US); Jill Louise Diniz, St. Pierce, FL (US)

(72) Inventors: Ronald Liborio Diniz, Ft. Pierce, FL (US); Jill Louise Diniz, St. Pierce, FL (US)

( * ) Notice: Subject to any disclaimer, the term of this patent is extended or adjusted under 35 U.S.C. 154(b) by 0 days.

(21) Appl. No.: 14/173,201

(22) Filed: Feb. 5, 2014

(65) Prior Publication Data

US 2014/0174016 A1 Jun. 26, 2014

Related U.S. Application Data

(63) Continuation-in-part of application No. 14/137,936, filed on Dec. 20, 2013.

(60) Provisional application No. 61/740,164, filed on Dec. 20, 2012.

(51) Int. Cl.

| | |
|---|---|
| ***E04H 12/34*** | (2006.01) |
| ***E04C 3/30*** | (2006.01) |
| ***E04H 12/18*** | (2006.01) |

(52) U.S. Cl.

CPC ..... *E04H 12/182* (2013.01); *E04C 3/30* (2013.01)

USPC ..... 52/123.1; 52/651.01; 52/651.07; 343/883

(58) Field of Classification Search

CPC ..... E04H 12/00; E04H 12/18; E04H 12/182; E04B 1/18; E04B 1/1903; E04B 1/1906; E04B 1/1909

USPC ..... 52/123.1, 632, 651.01, 651.07, 652.1; 343/875, 883

See application file for complete search history.

(56) References Cited

U.S. PATENT DOCUMENTS

| | | | | | |
|---|---|---|---|---|---|
| 2,942,700 | A | * | 6/1960 | Parmenter et al. | 52/121 |
| 3,284,972 | A | * | 11/1966 | Werner | 52/118 |
| 4,166,542 | A | * | 9/1979 | Bryan, Jr. | 212/231 |
| 5,052,645 | A | * | 10/1991 | Hixon | 248/125.2 |
| 5,557,892 | A | * | 9/1996 | Lavin | 52/121 |

* cited by examiner

*Primary Examiner* — William Gilbert
*Assistant Examiner* — Patrick Maestri
(74) *Attorney, Agent, or Firm* — Allen, Dyer, Doppelt, Milbrath & Gilchrist, P.A.

(57) ABSTRACT

A telescoping tower includes a plurality of nested tower sections extendable in a telescoping direction, each of the plurality of nested tower sections having a plurality of legs that define respective heights of the plurality of nested tower sections in the telescoping direction, each of the plurality of legs slidably engaging at least one leg of at least one adjacent one of the plurality of nested tower sections along an overlap in the respective heights thereof.

20 Claims, 4 Drawing Sheets

TELESCOPING TOWER AND LEGS

CROSS-REFERENCE TO RELATED APPLICATIONS

This application is a continuation-in-part of U.S. Non-provisional patent application Ser. No. 14/137,936, filed on Dec. 20, 2013, and claims the benefit of U.S. Provisional Patent Application Ser. No. 61/740,164 filed on Dec. 20, 2012, the contents of which applications are herein incorporated by reference in their entirety.

FIELD OF THE INVENTION

The present invention relates to telescoping towers, and more particularly, to legs usable in connection therewith.

BACKGROUND OF THE INVENTION

Traditional telescopic, crank-up, or lattice towers, as they may be referred to in the industry, consist of several tower sections, varying in size in order to slide in and out of one another and achieve the maximum elevation. These sections are connected together through a series of cables, pulleys and a winch responsible for raising and lowering sections individually or simultaneously. The process that combines cables, pulleys and a winch is referred to as "rigging" in the industry.

A shared problem in the telescopic, crank-up, and lattice tower industry arises from the spacing between the varying sized sections. This spacing or gap is typically measured as the distance between one leg of a section and the leg of the adjacent section. Known in the industry as "play between sections," the gap can be as small as ⅛ inch or as much as ¼ inch. While "section play" is required to allow the sections to raise and lower, it allows lateral and/or angular motion that applies undesired torque and adversely affects the overall strength and stability of telescopic, crank-up, or lattice towers with two or more sections. The effect is amplified with every additional section. In windy conditions, the play between sections creates pressure points at several different locations along the tower legs, potentially weakening these areas and increasing the probability of failure.

Some companies in the industry try to eliminate the play between sections by adding wheels, or rollers to the top of the outer section's legs, top and bottom of every inner section's legs in between and finally the lower legs of the inner most section. Unfortunately, this creates major stress on the points of contact where the wheels or rollers are located. In addition, it reduces the lifespan of the legs, pulleys and even the tower legs by creating wear points on the leg surfaces.

An improvement on this general concept involves the use of a slide bar mechanism. At the point where the slide bars meet play between sections is eliminated by the slide bars pressing up against one another. An example of this mechanism can be seen in U.S. Pat. No. 8,046,970, the contents of which are incorporated by reference herein, in their entirety. Nonetheless, further improvements are possible.

SUMMARY OF THE INVENTION

In view of the foregoing, it is an object of the present invention to provide an improved telescoping tower and leg therefor. According to an embodiment of the present invention, a telescoping tower includes a plurality of nested tower sections extendable in a telescoping direction, each of the plurality of nested tower sections having a plurality of legs that define respective heights of the plurality of nested tower sections in the telescoping direction, each of the plurality of legs slidably engaging at least one leg of at least one adjacent one of the plurality of nested tower sections along an overlap in the respective heights thereof.

According to an aspect of the present invention, a first tower section has a first leg extending in the telescoping direction, the first leg including first leg female and male sides extending in parallel in the telescoping direction and connected therealong by a first leg web. A second tower section has a second leg extending in the telescoping direction, the second leg including a second leg female side extending in the telescoping direction, a second leg slot extending in the telescoping direction being defined in the second leg female side. The first leg male side is slidably retained in the second leg female side with the first leg web extending through the second leg slot to support telescopic movement of the first tower section relative to the second tower section in the telescoping direction.

These and other objects, aspects and advantages of the present invention will be better appreciated in view of the drawings and following detailed description of preferred embodiments.

DETAILED DESCRIPTION OF PREFERRED EMBODIMENTS

Figure 1:
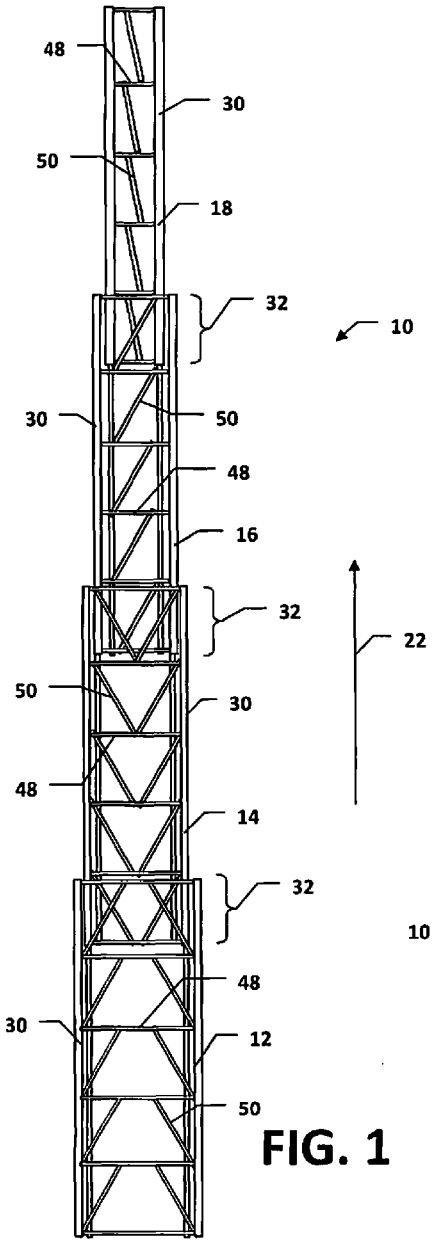
FIG. 1 is a side view of a telescoping tower, according to an embodiment of the present invention, in a fully extended configuration.
Figure 2:
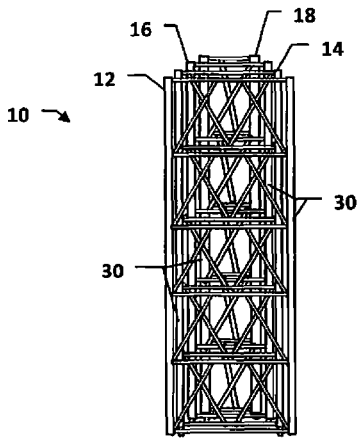
FIG. 2 is a side view of the telescoping tower of FIG. 1, in a fully retracted position.

Referring to FIGS. 1 and 2, according to an embodiment of the present invention, a telescoping tower 10 includes a plurality of nested tower sections 12-18 that are extendable in a telescoping direction 22. The sections 12-18 are extended in FIG. 1 and retracted in FIG. 2. Each of the sections 12-18 includes a plurality of legs 30 extending, and generally defining the height of their respective sections 12-18, in the telescoping general. Each of the legs 30 slidably engages at least one adjacent leg 30 of an adjacent one of the sections 12-18. In the case of the outer- and innermost nested sections 12, 18, the legs 30 each slidably engage one adjacent leg 30, whereas each leg of the intermediate sections 14, 16 will slidably engage two adjacent legs 30.

The slidable engagement between adjacent legs 30 is advantageously substantially continuous over all the overlap 32 in the heights of adjacent sections. As is explained in greater detail herein, the design of the legs 30 allows this continuous engagement to be maintained in both the extended and retracted positions of the tower 10, as well as throughout the transition therebetween. As a result, play between sections 12-18 is significantly reduced, enhancing the effective structural integrity of the telescoping tower 10.

Notably, the tower 10 is not limited to any particular rigging or other mechanism for expanding and/or retracting the sections 12-18, including both automated and manually actuated mechanisms. Additionally, the tower 10 could be transported to and anchored at a prospective site of use according to a variety of means. For example, the tower could be mounted horizontally to a trailer, and erected and expanded on the trailer when in use. Alternately, the tower could be removed from a trailer or other transport mechanism, and anchored to the ground or other mounting platform, in situ. Additionally, the expanded tower could be guyed or unguyed.

Figure 3:
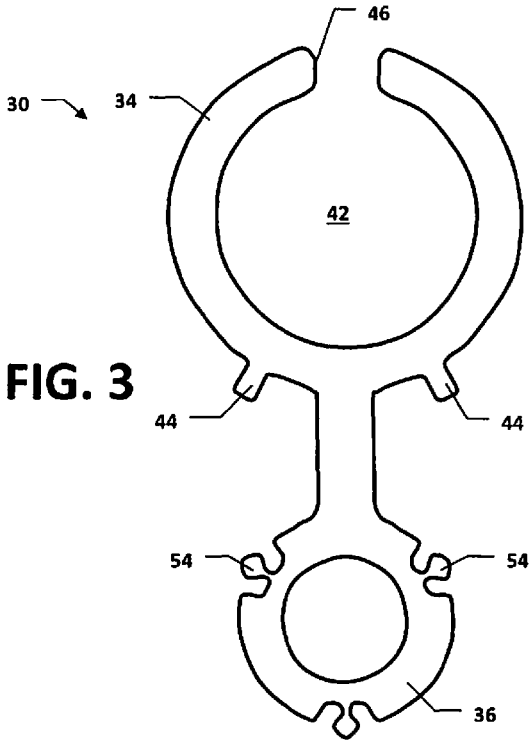
FIG. 3 is an end view of an exemplary leg of the telescoping tower of FIG. 1.
Figure 4:
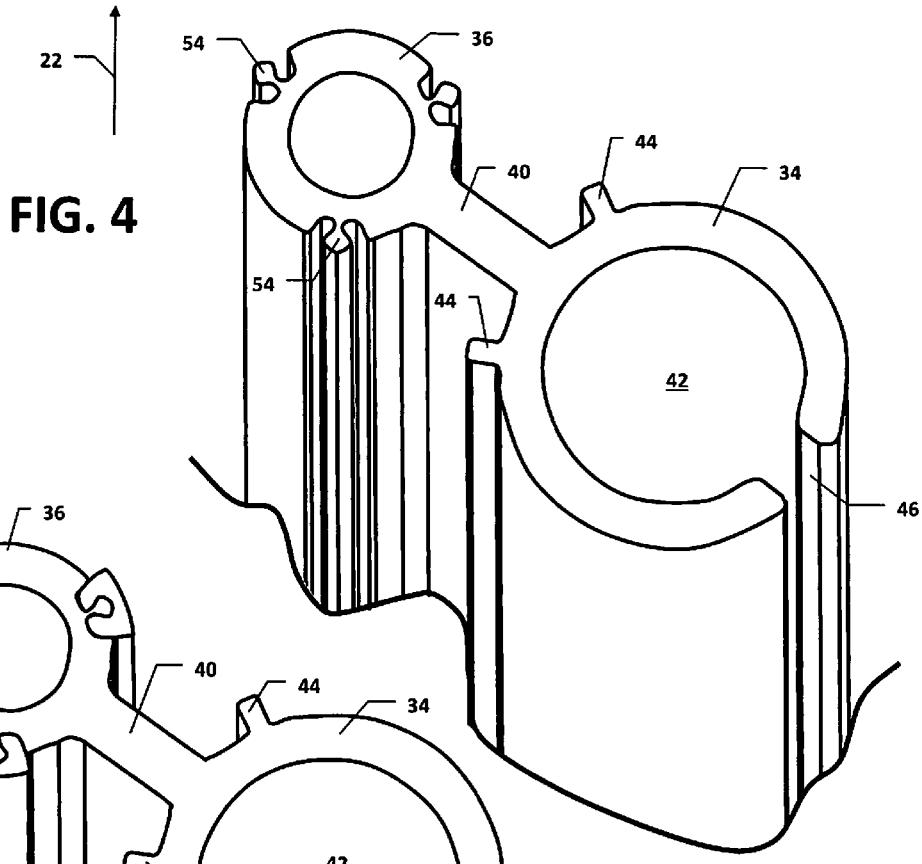
FIG. 4 is a partial perspective view of the leg of FIG. 3.
Figure 5:
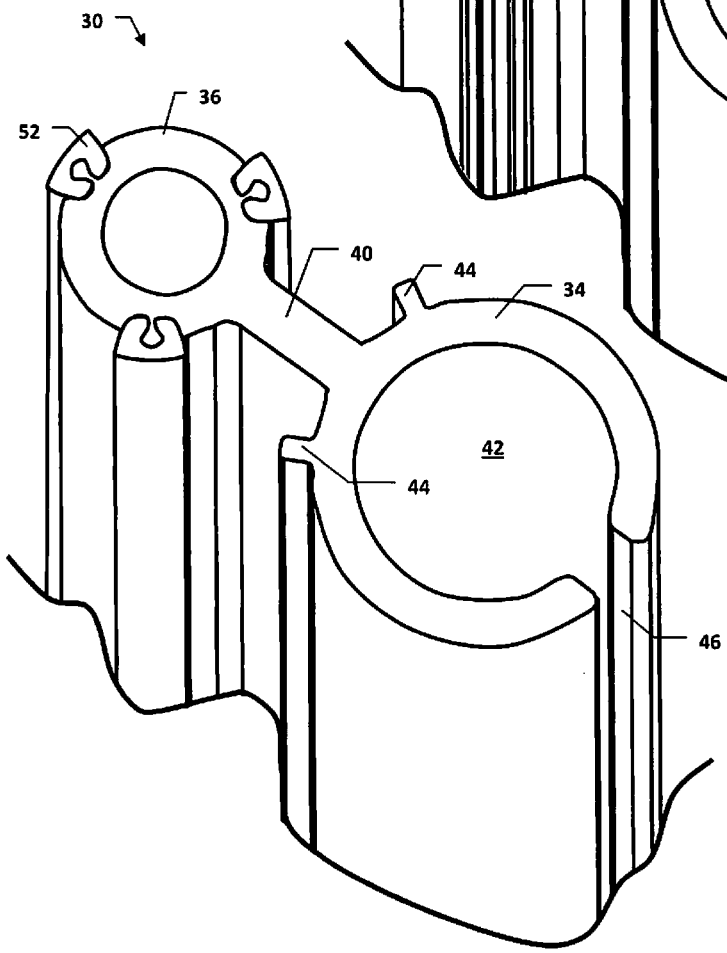
FIG. 5 is a partial perspective view of the leg of FIG. 3, with linear slide bearings mounted thereon.

Referring to FIGS. 3-5, an exemplary leg 30 includes a female side 34 and male side 36, which extend in parallel in the telescoping direction 22 and are connected by a web 40. Both the female and male side 34, 36 preferably extend for the entire length of the leg 30. Advantageously, the male side 36 is at least long enough to extend throughout the entire overlap 32 between adjacent sections when the tower 10 is fully extended in the telescoping direction 22. The web 40 is preferably continuous between the female and male sides 34, 36 in the telescoping direction, but could alternately be intermittent.

The female side 34 has a hollow interior 42 and defines a leg slot 46. Preferably, the leg slot 46 is slightly wider than the web 40 and the hollow interior 42 is dimensioned slightly larger than the male side 36, such that an identical male side could be slidably accommodated within the hollow interior 42 with an identical web extending through the leg slot 46. Additionally, the leg slot 46 is substantially narrower than the male side 36, such that the identical male side would be retained within the female side 34 and only capable of sliding movement in the telescoping direction 22. Also, the web 40 meets the female side 34 generally opposite the leg slot 46, such that the webs of adjacent legs would be aligned with one another.

Connection tabs 44 are formed on the female side 34, which facilitate the attachment of interconnection members thereto for interconnecting the legs of each tower sections 12-18. Exemplary interconnection members include rungs 48 and diagonals 50 (see FIG. 1). The connection tabs 44 are preferably located equidistant from opposite sides of the web 40, such that the web 40 bisects the apex of its respective corner of a tower section. For instance, in the case of a triangular tower section, the connection tabs 44 would be offset 30 degrees on either side of the web 40; in a square tower section, the connection tabs would be offset 45 degrees on either side of the web 40.

To facilitate sliding motion between adjacent legs 30, slide bearings 52 can be included so as to be between the male side 36 and the female side of an adjacent leg in which it is received. Preferably, linear slide bearings are used, and phenolic linear slide bearings are believed to be particularly advantageous. Slide bearing mounting rails 54 are located on the outer surface of the male side 36, with the mounting rails 54 extending in the telescoping direction 22, to receive the slide bearings 52. Alternately, the mounting rails 54 could be formed on the inner surface of the female side 34.

In the depicted embodiment, the female and male sides 34, 36 have complementary generally circular sections when viewed in the telescoping direction (as in FIG. 3). Alternately, other complementary shapes could be used, such a triangles or squares. Advantageously, the female and male sides 34, 36 and the web 40, as well as the connection tabs 44 and mounting rails 54, are formed as a single, unitary structure; for example, with the leg 30 being extruded. A strong but relatively lightweight metal, such as aluminum, is preferred, but other metals and other manufacturing processes, could be used. For example, legs could be formed from carbon fiber, rigid plastics material, or composite materials. Legs could be cast, machined and/or molded. For weight reduction, the male side 36 can advantageously be formed with a hollow interior, also.

Figure 6:
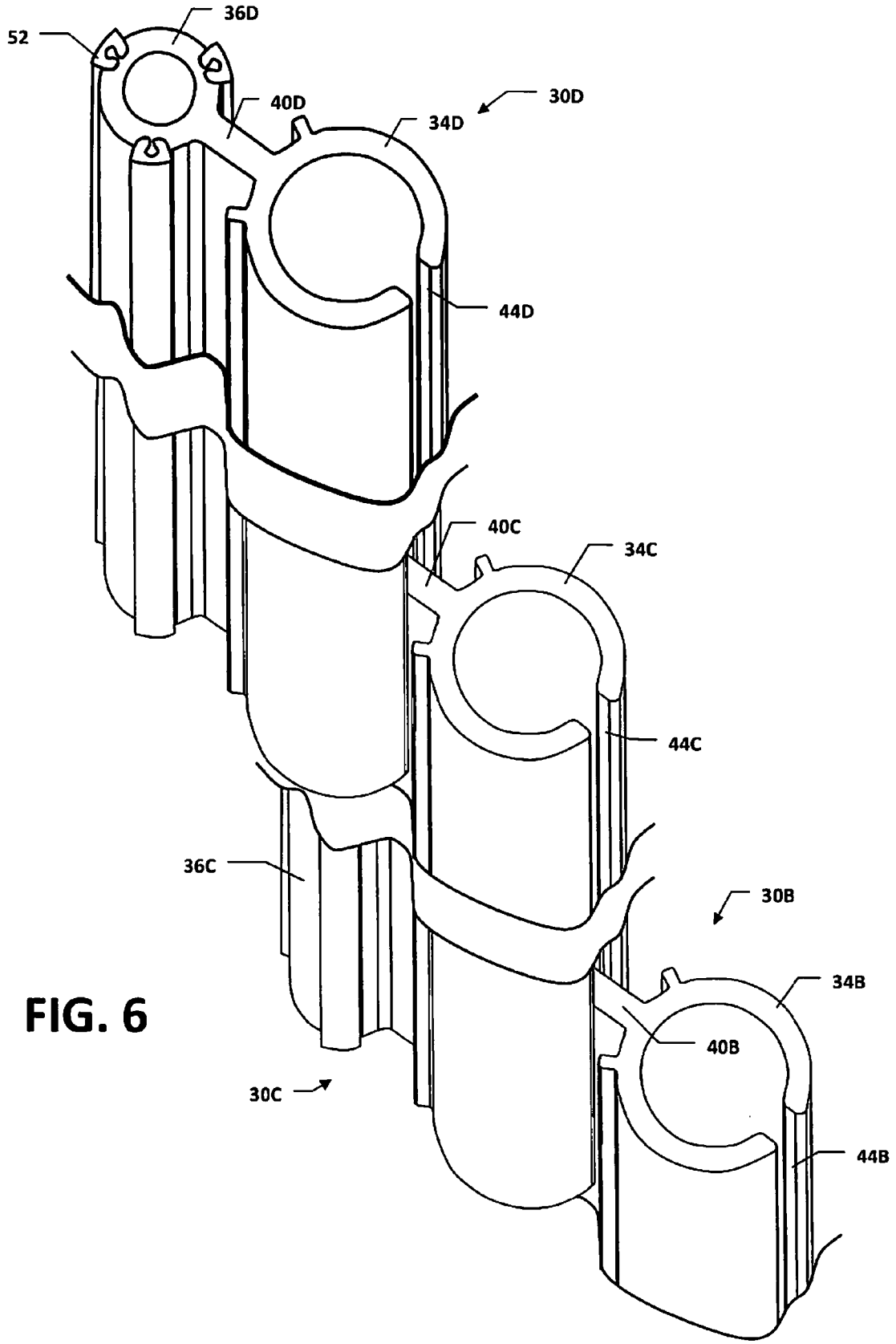
FIG. 6 is a partial perspective view of a plurality of slidably connected legs, according to another embodiment of the present invention.
Figure 7:
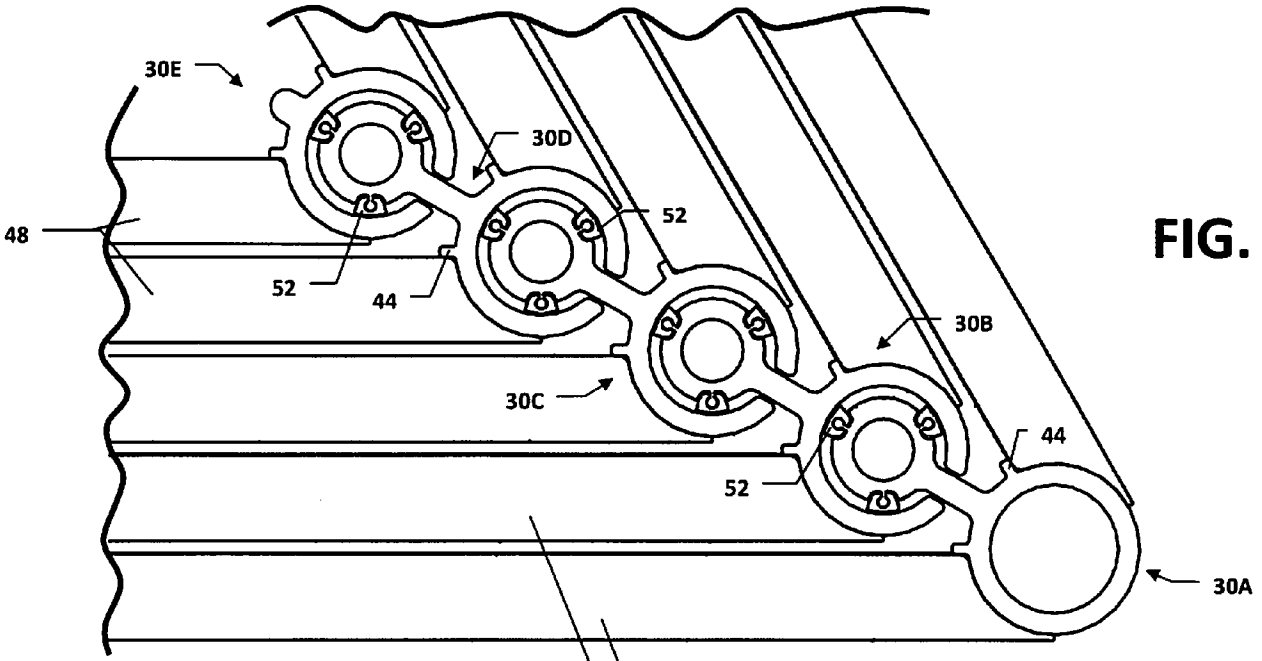
FIG. 7 is a partial end view of a telescoping tower, including the legs of FIG. 6.

Referring to FIGS. 6 and 7, a plurality of interconnected legs 30A-30E are shown. The legs 30A-30E are shown forming one corner of adjacent tower 10A sections, with rungs 40 extending therefrom attached to connection tabs 44. The intermediate legs 30B-30D are substantially identical, whereas the outermost leg 30A lacks a leg slot, as it does not need to receive the male side of an adjacent leg. Similarly, the innermost leg 30E lacks a male side, as there is no female side of an adjacent leg for it to be received in. Alternately, the outer- and/or innermost legs could be made identical with the intermediate legs.

Each leg 30A-30E slidably engages at least one adjacent leg, with the intermediate legs 30B-30D (shown particularly in FIG. 6), each slidably engage two adjacent legs. The female sides of more inwardly legs 30B-30E slidably retain therein the male sides of more outwardly legs 30A-30D, with the webs of the more outwardly legs extending through the leg slots of the more inwardly legs. Secure and stable extension and retraction in the telescoping direction 22 is thereby achieved, with minimal play between sections possible due the large contact area between legs throughout their overlapping heights. The linear slide bearings 52 between male and female sides of adjacent sections further facilitates sliding movement.

In addition to differently configured inner- and/or outermost legs, the present invention could be practiced with legs with changing dimensions. By way of illustration, each female section of a leg of the tower 10A is approximately the same diameter, as is each male section. However, the legs could, for example, get gradually smaller from outermost to innermost, as might be desired to reduce the weight of the top of the tower when extended. In such a tower, the outermost leg could have a male side somewhat smaller than the interior of its female side, so as to be slidably retained in a somewhat smaller female side of the adjacent leg. Thus, the sliding relationship and mutual engagement between legs would be retained, but the innermost legs would be smaller and lighter than the outermost legs.

Figure 9:
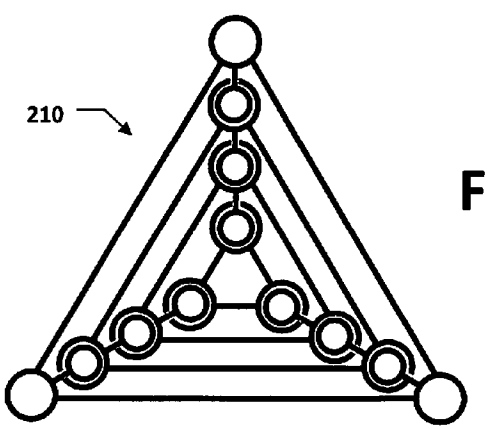
FIGS. 8 and 9 and are schematic end views of telescoping towers, according to further embodiments of the present invention.
Figure 8:
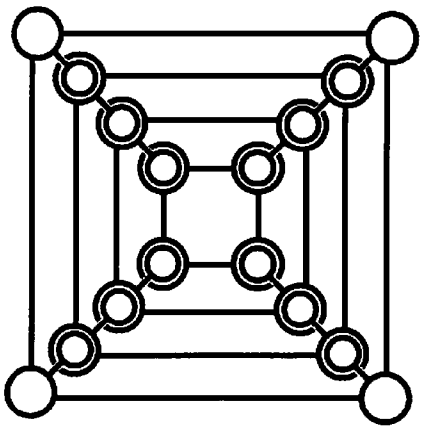

In most telescoping towers, the legs will be interconnected to form a closed geometric figure. For example, a four legged tower 110 forms a square (as in FIG. 8) or a three legged tower 210 forms a triangle (as in FIG. 9). However, towers consisting of any number of legs and forming any open or closed geometric figure could be advantageously made using the legs of the present invention. Additionally, a telescoping tower could be made of as few as two sections, up to as many as were needed and feasible for a given application.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. A telescoping tower comprising:

a first tower section having a first leg extending in a telescoping direction, the first leg including first leg female and male sides extending in parallel in the telescoping direction and connected therealong by a first leg web; and a second tower section having a second leg extending in the telescoping direction, the second leg including a second leg female side extending in the telescoping direction, a second leg slot extending in the telescoping direction being defined in the second leg female side;

wherein the first leg male side is slidably retained in the second leg female side with the first leg web extending through the second leg slot to support telescopic movement of the first tower section relative to the second tower section in the telescoping direction; and wherein the first leg male side is wider than the second leg slot, preventing withdrawal of the first leg male side therethrough.

2. The telescoping tower of claim 1, further comprising:

a third tower section having a third leg extending in the telescoping direction, the third leg including a third leg female side extending in the telescoping direction, a third leg slot extending in the telescoping direction being defined in the third leg female side;

wherein the second leg also includes a second leg male side extending in parallel with the second leg female side in the telescoping direction and connected therealong by a second leg web, and the second leg male side is slidably retained in the third leg female side with the second leg web extending through the third leg slot to support telescopic movement of the second tower section relative to the third tower section in the telescoping direction.

3. The telescoping tower of claim 1, wherein an outermost of a plurality of tower sections including the first and second tower sections has no slot in a female side of a leg thereof, and an innermost of the plurality of tower sections has no male side of a leg thereof.

4. The telescoping tower of claim 1, wherein the first and second tower sections each further include a respective first and second pluralities of additional legs, each leg of the first and second pluralities of additional legs being substantially identical to the first leg and second leg, respectively, and each of second plurality of additional legs being slidably connected to a respective one of the first plurality of additional legs in substantially the same manner as the first and second legs.

5. The telescoping tower of claim 4, wherein both the first leg and first plurality of additional legs, and the second leg and second plurality of additional legs, are connected to form a closed geometric figure when viewed in the telescoping direction.

6. The telescoping tower of claim 5, wherein the closed geometric figure is a triangle.

7. The telescoping tower of claim 5, wherein the closed geometric figure is a square.

8. The telescoping tower of claim 4, wherein the second tower section is nested within the first tower section and telescopically extendable therefrom.

9. The telescoping tower of claim 4, wherein the first and second tower sections further include respective first and second pluralities of interconnection members, the first plurality of interconnection members connecting the first leg and first plurality of additional legs, the second plurality of interconnection members connecting the second leg and second plurality of additional legs.

10. The telescoping tower of claim 9, wherein the first and second pluralities of interconnection members include respective first and second pluralities of rungs and diagonals.

11. The telescoping tower of claim 9, wherein both the first leg and first plurality of additional legs, and the second leg and second plurality of additional legs, include a plurality of connection tabs extending from female sides thereof and affixed to the respective first and second pluralities of interconnection members.

12. The telescoping tower of claim 1, wherein the first leg male side and the second leg female side have complementary generally circular sections when viewed in the telescoping direction.

13. The telescoping tower of claim 1, wherein the first leg and the second leg have substantially identical sections when viewed in the telescoping direction.

14. A leg for a telescoping assembly, the leg comprising:

a female side having a hollow interior extending in a telescoping direction, a leg slot extending in the telescoping direction being defined in the second leg female side and communicating with the hollow interior;

a first male side extending in the telescoping direction in parallel with the female side; and a first web extending in the telescoping direction and connecting the female side and the male side;

wherein the first male side is wider than the lea slot and the first web is narrower than the first slot.

15. The leg of claim 14, wherein the female side and leg slot are dimensioned to slidably retain for telescopic movement a second male side and second web identical with the first male side and first web, respectively, with the second web extending through the leg slot.

16. The leg of claim 14, further comprising a plurality of connection tabs extending from the female side and configured for connection to a plurality of interconnection members.

17. The leg of claim 16, wherein the plurality of connection tabs include at least two connection tabs equidistant from opposite sides of the first web.

18. The leg of claim 14, wherein the female side, first male side and first web are formed as a single, unitary structure.

19. The leg of claim 18, wherein the leg is extruded.

20. A telescoping tower comprising:

a plurality of nested tower sections extendable in a telescoping direction, each of the plurality of nested tower sections having a plurality of legs that define respective heights of the plurality of nested tower sections in the telescoping direction, each of the plurality of legs slidably engaging at least one leg of at least one adjacent one of the plurality of nested tower sections along all of an overlap in the respective heights thereof;

wherein the slidable engagement between each of the plurality of legs and the at least one leg of the at least one adjacent one of the plurality of nested tower sections includes a male side of one of the legs retained in a female side of the adjacent leg, withdrawal of the male side from the female side transverse the telescoping direction being prevented by a slot in the female side that is narrower than the male side.

* * * * *